United States Patent [19]

Hough et al.

[11] Patent Number: 4,612,915

[45] Date of Patent: Sep. 23, 1986

[54] DIRECT BONE CONDUCTION HEARING AID DEVICE

[75] Inventors: Jack V. D. Hough, Yukon; Gordon L. Richard, Minco, both of Okla.; Kenneth E. Barton, Jr., Jacksonville, Fla.; Paul DiCarlo, Jacksonville, Fla.; Robert Y. Chow, Jacksonville, Fla.

[73] Assignee: Xomed, Inc., Jacksonville, Fla.

[21] Appl. No.: 737,188

[22] Filed: May 23, 1985

[51] Int. Cl.[4] ..... H04R 9/00; H04R 25/00

[52] U.S. Cl. ..... 128/1 R; 128/421; 179/107 BC; 179/107 R

[58] Field of Search ..... 128/1 R, 421; 179/107 BC, 107 R, 107 E

[56] References Cited

U.S. PATENT DOCUMENTS

| | | | |
|---|---|---|---|
| 2,402,392 | 6/1946 | Goldschmidt . | |
| 2,832,892 | 4/1958 | Knavert | 179/107 BC |
| 3,209,081 | 9/1965 | Ducote et al. . | |
| 3,870,832 | 3/1975 | Fredrickson . | |
| 4,284,856 | 8/1981 | Hockmair | 179/107 E |
| 4,352,960 | 10/1982 | Dormer et al. . | |
| 4,419,995 | 12/1983 | Hockmair | 179/107 |
| 4,498,461 | 2/1985 | Hakansson . | |

OTHER PUBLICATIONS

Scand Audiol 13; Mar. 1984; "Hearing Thresholds With Direct Bone Bone Conduction Versus Conventional Bone Conduction"; by B. Hakansson, A. Tjellstrom and U. Rosenhall.

"Direct Bone Anchorage of External Hearing Aids"; by A. Tjellstrom, J. Lindstrom, O. Hallen, T. Albrektsson and P. J. Bronemark; J. Biomed Eng., vol. 5; Jan. 1983.

"Bone Conduction Speech Discrimination"; by Mendell Robinson, MD and Stephen D. Kasden, MS; Arch Otolaryngol, vol. 103, Apr, 1977.

*Primary Examiner*—William L. Freeh

*Attorney, Agent, or Firm*—Bell, Seltzer, Park & Gibson, P.A.

[57] ABSTRACT

A direct bone conduction hearing aid device is disclosed and includes a sound processor for receiving sound and generating an amplified electromagnetic signal in response thereto. This signal is transmitted to a subcutaneously implanted vibration generating means which is secured to a skull bone of the user and which includes magnetic means. An analog signal causes the magnet to vibrate and these vibrations are transmitted to the skull bone and thence to the cochlea to create the perception of sound.

20 Claims, 12 Drawing Figures

DIRECT BONE CONDUCTION HEARING AID DEVICE

REFERENCE TO EARLIER FILED APPLICATION

This application is filed under the provisions of 35 U.S.C. 120 from copending application Ser. No. 674,176, filed Nov. 23, 1984, now abandoned.

FIELD OF THE INVENTION

This invention relates to devices for aiding the hearing impaired and more particularly to such a device which stimulates the inner ear to create the perception of sound through conduction of vibrations through the bone structure of the skull.

BACKGROUND OF THE INVENTION

The normal perception of sound occurs when sound waves strike the tympanic membrane and cause it to vibrate. These vibrations are transmitted through the three tiny bones in the middle ear (ossicular chain) to the cochlea in the inner ear, which results in electrical impulses being transmitted through the auditory nerve to the brain. Even if the sound conducting mechanisms of the middle ear are functioning perfectly, a hearing loss can be experienced if the inner ear is damaged.

A conventional, "air conduction" hearing aid can sometimes be used to overcome a hearing loss due to inner ear damage (sensorineural loss) and/or hearing loss due to a mild impediment of the sound conducting mechanism of the middle ear. A conventional air conduction hearing aid works by simply amplifying the incoming sound and delivering the amplified sound signal by way of a speaker positioned in the ear canal. This amplified sound simply "overdrives" the ear's sound conducting mechanism.

Since an air conduction hearing aid must have some of its componetry in the ear canal, and since it also requires a fairly normal tympanic membrane and middle ear space, some hearing impaired persons are unable to derive any benefit from a device.

Persons who cannot benefit from an air conduction hearing aid can sometimes benefit from a "bone conduction" hearing aid. A bone conduction hearing aid works by converting the sound signal into a mechanical vibratory stimulus. Heretofore, the vibrating portion of the aid has been placed against the skin, usually behind the ear, under some pressure. The vibrator transmits its vibrations through the skin and soft tissue into the bone structure of the skull. The vibration of the skull stimulates the cochlea and a sound is perceived. Such bone conduction devices are not very popular due to several limitations. First, the devices are bulky and must be worn on a head band or a special eyeglass frame in order to keep the vibrator pressed tightly against the skull. In addition, because the vibration must be transmitted through the soft tissue overlying the skull, the fidelity of sound and the efficiency of the device are poor.

Proposals have been made for improving bone conduction devices for stimulating the inner ear. One such proposal is disclosed in U.S. Pat. No. 3,209,081 in which a radio receiver is implanted underneath the skin and includes a vibration generating means which is connected to the temporal bone subcutaneously. A transmitter may be located at any remote place on the body of the user within the range of the implanted radio receiver for generating a modulated signal in response to sound received by a microphone. This modulated signal is received by the radio receiver and the vibrator is caused to vibrate in response to the modulated signal and set up vibrations within the temporal bone which in turn stimulates the inner ear to create a perception of sound. This implanted radio receiver is quite complex and includes numerous implanted electronic components including a power supply, which are susceptible to malfunction and other potential problems which could cause extreme difficulty due to the implanted nature thereof.

A second proposal relates to some experimental work conducted in Europe and described in a recent published paper wherein a direct bone conduction device was implanted which included a bone screw implanted directly in the temporal bone subcutaneously and a post connected directly thereto. This post extends percutaneously (through the skin) to a location externally of the skin. A vibrator which creates vibrations in response to a modulated signal is connected to this post and vibrations are transmitted by the post to the bone screw and thence to the temporal bone of the skull to stimulate the inner ear and create the perception of sound. This device has distinct disadvantages, not the least of which are the likelihood of infection and the undesirability of a ceramic element extending permanently through the skin from aesthetic, psychological and comfort standpoints.

OBJECTS AND SUMMARY OF THE INVENTION

With the foregoing in mind, it is an object of the present invention to provide a direct bone conduction hearing aid device which is very simple and which overcomes the deficiencies and problems heretofore encountered with bone conduction hearing aid devices.

A more specific object of the present invention is to provide a hearing aid device for the hearing impaired in which direct conduction of vibrations into the bone is provided and in which the signal transmitting device is held in place without unsightly or uncomfortable external devices.

These objects are accomplished by the present invention in which a sound processor including a sensitive microphone is located externally of the body of the user to receive sound and a suitable electronic means is connected to the microphone for converting the sound waves received by the microphone into an electromagnetic field. This electronic means includes an output transmitter adapted to be positioned against the skin over a skull bone of the hearing impaired person, preferably over the mastoid area of the temporal bone of the skull behind the ear of the user, for transmitting the electromagnetic field transcutaneously and a first magnetic means, preferably a permanent magnet. Additionally, vibration generating means is adapted to be implanted subcutaneously in the skull bone of the hearing impaired person, preferably in the mastoid area of the temporal bone behind the ear, and includes means for securing the vibration generating means subcutaneously to a skull bone, preferably a bone screw adapted to be implanted directly into the temporal bone behind the ear. The vibration generating means further includes second magnetic means, preferably a permanent magnet, for cooperating with said first magnetic means to hold the transmitter in position supercutaneously on the skull, for receiving the electromagnetic signal from the transmitter of the sound processing means, and for vibrating the skull bone in response to the electromagnetic signal. Such vibrations are then conducted through the bones of the skull and thereby to the cochlea to stimulate the inner ear to create the perception of sound.

BRIEF DESCRIPTION OF THE DRAWINGS

Some of the features and advantages of the invention having been briefly stated, others will appear from the detailed description which follows, when taken in connection with the accompanying drawings, in which.

DETAILED DESCRIPTION OF THE ILLUSTRATED EMBODIMENTS

Figure 1:
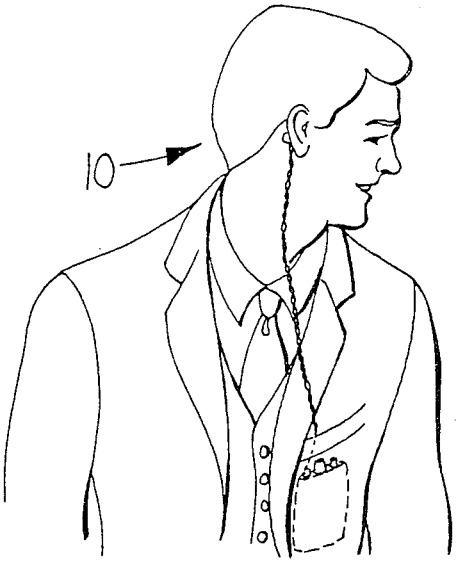
FIG. 1 is a perspective view illustrating the manner of use of the direct bone conduction hearing aid device of the present invention.
Figure 2:
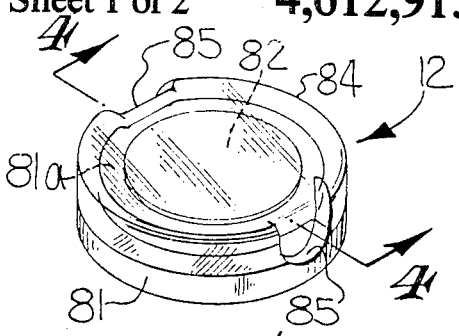
FIG. 2 is an enlarged perspective view of the vibration generating means of the hearing aid device of the present invention.
Figure 3:
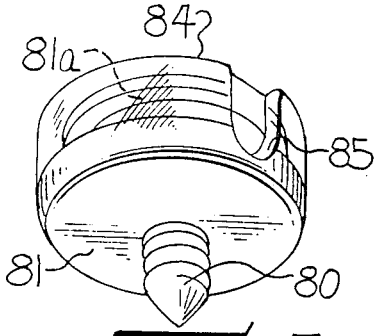
FIG. 3 is a prospective view of the vibration generating means shown in FIG. 2 looking upwardly from the bottom thereof.

Referring now more specifically to the drawings, the direct bone conduction hearing aid device of the present invention is generally indicated at 10 in FIG. 1 with a preferred embodiment being illustrated in FIGS. 2–8 and alternative embodiments being illustrated in FIGS. 9–12.

The hearing aid device 10 comprises a sound processing means 11 (FIG. 7) and vibration generating means 12. The sound processing means 11 is illustrated as being confined in a case 11*a* and including a pair of output transmitters 13 connected to the case 11*a* by suitable wiring 14. Whether one or two output transmitters 13 are used will depend upon whether the hearing aid device 10 is to be utilized in connection with one or both ears of a hearing impaired person. Also, the case 11*a* could be formed in different configurations and could be located behind the ear or in glasses, etc. of the user. The sound processing means 11 includes electronic circuitry as illustrated by way of example in FIG. 8.

Figure 8:
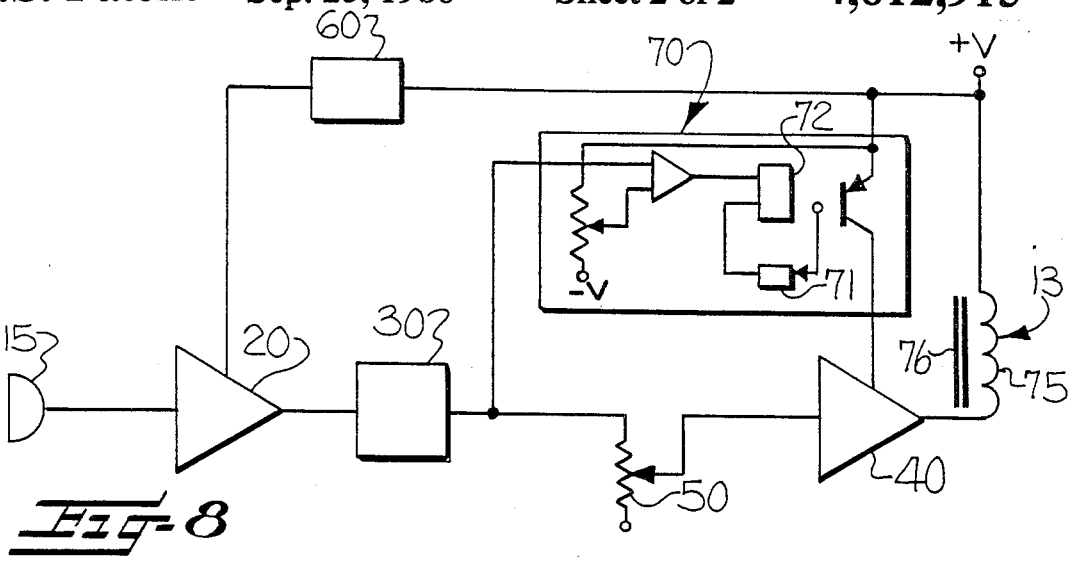
FIG. 8 is a schematic circuit diagram of the sound processor illustrated in FIG. 7.

As shown in FIG. 8, the electronic sound processing circuitry includes a sensitive microphone 15 for converting sound waves into electrical signals that are processed and passed to output transmitter (inductive coil) 13 for generating at the output transmitter 13 an electromagnetic field having an amplitude proportional to the amplitude of the sound waves received by the microphone 15.

Microphone 15 includes a diaphragm or membrane (not shown) which vibrates in response to the sound waves impinging thereon. The electrical signal from the microphone 15 is then amplified by a pre-amplifier 20. This signal is then passed through a low frequency cutoff passive filter 30. The amplified and filtered signal is then fed to an output amplifier 40 through a volume control 50 which provides a full or attenuated signal from the pre-amplifier to the amplifier. The output amplifier 40 amplifies the signal and then drives the output transmitter (inductive coil) 13.

A voltage regulation/isolation circuitry 60 minimizes crosstalk through the power supply (not shown) from amplifier to pre-amplifier providing virtually a distortionless power source for both.

A circuit cutoff circuit 70 acts to conserve battery energy. This circuit cutoff 70 simply removes all power to the output stage extending battery life if the device is on and is not required to function for approximately one minute. In the event a sound signal is received by the microphone 15 when the power is removed from the output stage, the power is restored by the circuit cutoff circuit 70 and normal operation is continued.

Specifically, the cutoff circuit 70 operates by generating a series of timed pulses generated by a clock 71 which are counted by a counter 72. The counter is reset when a sound signal is processed, not allowing the counter 72 to reach its full count which takes approximately one minute of no sound processing activity. If the counter 72 is allowed to reach its full count, the output amplifier 40 will return to its non-energized state.

Output transmitter 13 comprises an induction coil 75 wound about a core 76 which contains a first magnetic means. This first magnetic means may be of any suitable type, but preferably is a permanent magnet such as a samariam-cobalt type, and is formed in such manner that it may be included in the core 76 about which induction coil 75 is wound.

As stated previously, vibration generating means 12 is adapted to be implanted subcutaneously for receipt of the signal by electromagnetic coupling from output transmitter 13 for causing vibration of the skull. Vibration generating means 12 includes means for securing the vibration generating means 12 to a skull bone of the hearing impaired person, preferably in the form of a bone screw 80 adapted to be inserted in the mastoid area of the temporal bone behind the ear of a hearing impaired person. Bone screw 80 has its upper end threadably received in a cap 81 to firmly and structurally connect the cap 81 to the bone screw 80. Bone screw 80 and cap 81 are formed of tissue tolerant material, such as titanium.

Figure 4:
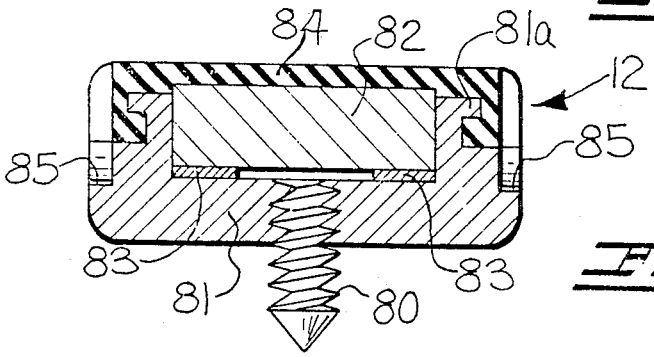
FIG. 4 is a transverse sectional view taken substantially along line 4—4 in FIG. 2.

Cap 81 has a flange 81*a* extending around the upper periphery thereof and defining an upwardly opening, centrally positioned cavity therewithin (FIG. 4). The flange 81*a* also has an outwardly facing groove in the outer side thereof.

A second magnetic means, preferably in the form of a second permanent magnet 82, is mounted within the upwardly opening cavity defined within flange 81*a* of cap 81 and is of a size so as to snugly fit within the cavity and have its outer periphery closely adjacent or in contact with the flange 81*a*. Magnet 82 is coated with a biocompatible material, such as paralyene, and preferably is of the samariam-cobalt type. Obviously, any suitable permanent magnet may be used provided that it has the sufficient magnetic field characteristics and long life needed for this application.

The second permanent magnet 82 is firmly anchored to cap 81 by an adhesive 83 placed between the bottom of the magnet and cap 81. Finally, the outer surface of the magnet 82 and of the flange 81*a* is covered by a suitable tissue tolerant material 84, such as silicone. It is noted that the silicone 84 is molded in place and includes a portion which is received within the outwardly facing groove in flange 81*a* to firmly anchor the silicone cover 84 to the cap 81. The cover 84 further protects the magnet 82 and the upper portion of the cap 81 from the surrounding tissue once the vibration generating means 12 is implanted.

Preferably, a pair of concave depressions 85 are formed in diametrically opposed sections of the cover 84 and cap 81 for receipt of a suitable tool to be used to implant the bone screw 80 in the temporal bone.

Figure 5:
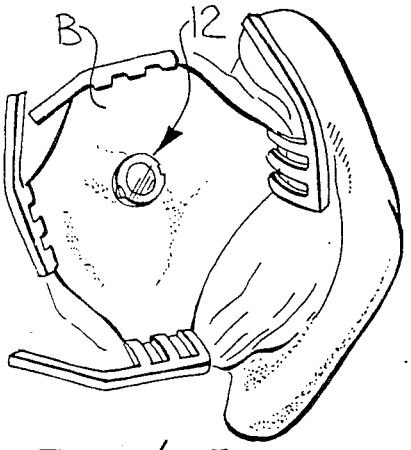
FIG. 5 is a fragmentary elevation view illustrating the manner of implantation of the vibration generating means shown in FIGS. 2 and 3.

The procedure to be employed in the implantation of the vibration generating means 12 is illustrated in FIG. 5 and constitutes a surgical procedure in which an incision is made in the skin and underlying tissue to expose the mastoid area of the temporal bone behind one or both ears. The bone screw 80 is implanted directly in the mastoid area of the temporal bones B by a pilot hole being drilled therein and then the screw 80 is screwed into the bone. Then, the skin S and underlying soft tissue T are replaced over the implanted device and suitably sutured.

Figure 6:
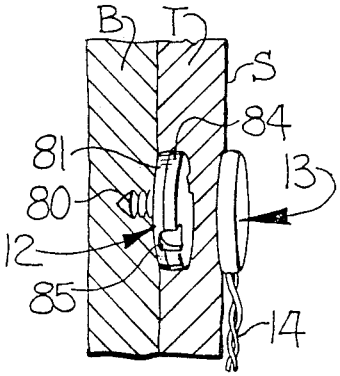
FIG. 6 is an enlarged fragmentary sectional view illustrating the implanted vibration generating means and associated output transmitter which causes vibration in the vibration generating means.
Figure 7:
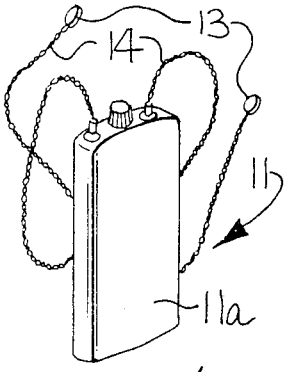
FIG. 7 is a perspective view of a sound processor forming a part of the hearing aid device of the present invention

As shown in FIG. 6, the vibration generating means 12 is implanted in the bone B beneath the tissue T and remains underneath the skin S. When the hearing aid device 10 of the present invention is desired to be used, it is only necessary to place the output transmitter 13 externally of the skin S in juxtaposed relation to the implanted vibration generating means 12. The permanent magnets located in the output transmitter 13 and the vibration generating means 12 serve to hold the output transmitter 13 in operative position relative to the implanted vibration generating means 12.

In operation, the sound processor 11 receives sound by way of microphone 15 and such sound is converted into an amplified electrical signal by the pre-amplifier 20, amplifier 40 and output transmitter 13. An electromagnetic field is generated by the inductive coil 76 of transmitter 13 and transmitted to the implanted vibration generation means 12 which causes the second permanent magnet 82 to vibrate in response to the amplitude of the field. Since permanent magnet 82 is firmly anchored to cap 81, the vibrations generated by magnet 82 are transmitted directly to cap 81 and thence to bone screw 80. The implanted bone screw 80 transmits such vibrations to the temporal bone and such vibrations are conducted by the bone structure of the skull to the cochlea to stimulate the inner ear to create the perception of sound.

Considering variations and alternative embodiments to the preferred form of the direct bone conduction hearing aid device 10 described above, it is possible that the vibration generating means 12 could be secured subcutaneously to any of the skull bones on the hearing impaired person for being vibrated to transmit such vibrations through the bones of the skull to stimulate the inner ear to create the preception of sound in the hearing impaired person, although the mastoid area of the temporal bone behind at least one ear of the hearing impaired person is preferred.

Figure 9:
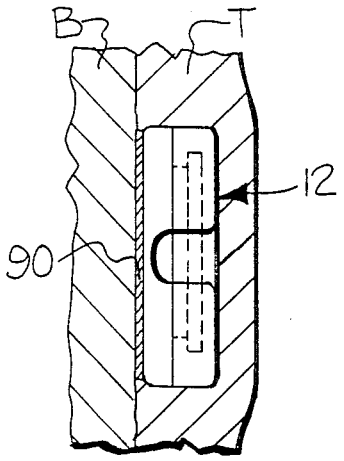
FIGS. 9–12 are enlarged fragmentary sectional views illustrating alternative embodiments of the implanted vibration generating means.
Figure 10:
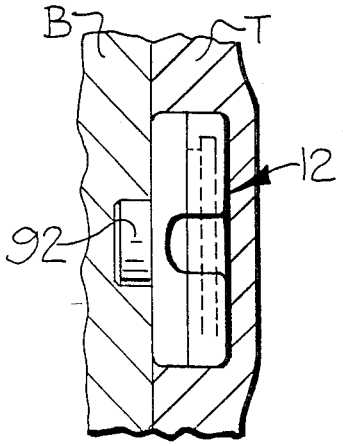

Additionally, although the means for securing the vibration generating means 12 to a skull bone of the hearing impaired person is preferably in the form of a bone screw 80, other securement means could be utilized. As illustrated in FIG. 9, this securement means is in the form of adhesive 90 for adhesively securing the vibration generating means 12 directly to a skull bone of the user. As illustrated in FIG. 10, the means for securing the vibration generating means 12 to a skull bone of the hearing impaired person is in the form of a post 92 which is implanted into a cut-out portion of the skull bone of the user and may include a porous coating thereon for allowing the skull bone to grow into the post for securing the post therein or the post 92 may be adhesively secured within such cut-out portion of the skull bone of the user.

Figure 11:
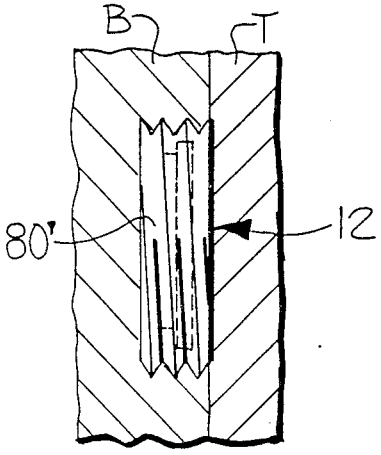
Figure 12:
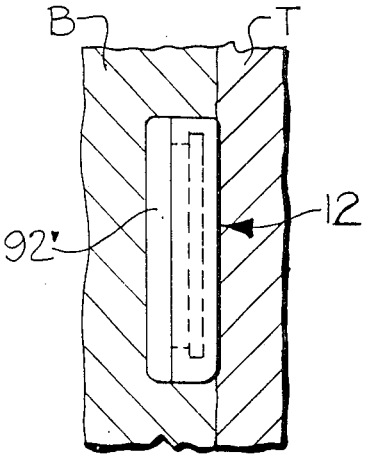

As illustrated in FIG. 11, the entire vibration generating means 12 may be in the form of a bone screw 80' for being imbedded directly into the skull bone of the user. Alternatively, as illustrated in FIG. 12, the entire vibration generating means 12 could be in the form of a post 92' which is imbedded directly into a cut-out in the skull bone of the user and may include a porous coating thereon for ingrowth of the skull bone to secure the vibration generating means in the cut-out portion of the skull bone or may be adhesively secured therein.

Lastly, the first and second magnetic means of the output transmitter 13 of the sound processing means 11 and of the vibration generating means 12, respectively, could take various alternative forms. For example, at least one of these first and second magnetic means could comprise a magnet, including a permanent magnet as described above; whereas, the other of the first and second magnetic means could comprise magnetically attractive material, such as ferromagnetic material. Other combinations may be possible so long as the second magnetic means of the vibration generating means 12 (1) cooperates with the first magnetic means of the transmitter 13 to hold the transmitter 13 in position supercutaneously on the skull of the hearing impaired person, (2) receives the electromagnetic signal from the transmitter 13 of the sound processing means 11, and (3) vibrates the skull bones of the hearing impaired person in response to such electromagnetic signal, whereby vibrations are generated subcutaneously in response to the analog electromagnetic signal and conducted through the bones of the skull to stimulate the inner ear to create the preception of sound in the hearing impaired person.

In the drawings and specification there have been disclosed typical preferred embodiments of the invention, and although specific terms are employed, they are used in a generic and descriptive sense only, and not for the purposes of limitation.

What is claimed is:

1. A direct bone conduction hearing aid device characterized by increased comfort and aesthetic appearance, said device comprising:

sound processing means for converting sound into an analog electromagnetic signal and including an output transmitter for transmitting the electromagnetic signal and being adapted to be placed supercutaneously on the skull of a hearing impaired person and having first magnetic means therein; and vibration generating means adapted to be implanted subcutaneously and comprising means for securing said vibration generating means subcutaneously to a skull bone of the hearing impaired person and second magnetic means (1) for cooperating with said first magnetic means to hold said transmitter in position supercutaneously on the skull of the hearing impaired person, (2) for receiving the electromagnetic signal from said transmitter of said sound processing means, and (3) for vibrating the skull bone in response to such electromagnetic signal; whereby, vibrations are generated subcutaneously in response to the analog electromagnetic signal and conducted through the bones of the skull to stimulate the inner ear to create the perception of sound in the hearing impaired person.

2. A hearing aid device, according to claim 1, wherein said means for securing said vibration generating means subcutaneously comprises a post member for embedding in a cut-out portion of the skull bone.

3. A hearing aid device, according to claim 1, wherein said means for securing said vibration generating means subcutaneously to a skull bone of the hearing impaired person comprises means for securing said vibration generating means to the mastoid area of the temporal bone behind at least one ear of the hearing impaired person.

4. A hearing aid device, according to claim 1 or 3, wherein said means for securing said vibration generating means subcutaneously comprises a bone screw for being implanted in the skull bone.

5. A hearing aid device, according to claim 4, in which said bone screw comprises and also functions as said second magnetic means.

6. A hearing aid device, according to claim 1 or 3, wherein said means for securing said vibration generating means subcutaneously comprises adhesive means.

7. A hearing aid device, according to claim 1, wherein at least one of said first and second magnetic means comprises a magnet.

8. A hearing aid device, according to claim 7, wherein at least one of said first and second magnetic means comprises magnetically attractive material.

9. A hearing aid device, according to claim 7 or 8, wherein said magnet comprises a permanent magnet.

10. A hearing aid device, according to claim 8, wherein said magnetically attractive material comprises ferromagnetic material.

11. A hearing aid device, according to claim 1, wherein said first and second magnetic means comprise permanent magnets.

12. A direct bone conduction hearing aid device characterized by increased comfort and aesthetic appearance, said device comprising:

sound processing means for converting sound into an analog electromagnetic signal and including an output transmitter for transmitting the electromagnetic signal and being adapted to be placed supercutaneously behind at least one ear of a hearing impaired person and having a first permanent magnet means therein; and vibration generating means adapted to be implanted subcutaneously and comprising at least one bone screw for being implanted in the mastoid area of the temporal bone behind at least one ear of the person and a second permanent magnet means connected to said bone screw (1) for cooperating with said first permanent magnet means to hold said transmitter in position supercutaneously behind the ear of the hearing impaired person, (2) for receiving the electromagnetic signal from said transmitter of said sound processing means, and (3) for vibrating said bone screw and the temporal bone of the hearing impaired person in response to such electromagnetic signal; whereby vibrations are generated subcutaneously in response to an analog electromagnetic signal and conducted through the bones of the skull to stimulate the inner ear to create the perception of sound in the hearing impaired person.

13. A hearing aid device, according to claim 12, wherein said output transmitter includes an induction coil wound around a core, and wherein said first permanent magnet means is located in the core of said induction coil.

14. A hearing aid device according to claim 12 wherein said sound processing means includes a sensitive microphone for receipt of sound and electronic means connected to said microphone and said output transmitter for generating at said transmitter an electromagnetic field having an amplitude proportional to the amplitude of the sound waves received by said microphone.

15. A hearing aid device, according to claim 12, wherein said second permanent magnet means is adhered to said bone screw and is encased in a biocompatible material.

16. A hearing aid device, according to claim 15, wherein said bone screw includes a cap on the end thereof opposite the end adapted to be implanted, said second permanent magnet means is adhered to said cap, and said biocompatible material encases said second permanent magnet means and a portion of said cap.

17. A direct bone conduction hearing aid device characterized by increased comfort and aesthetic appearance, said device comprising:

sound processing means for converting sound into an analog electromagnetic signal and including a sensitive microphone, electronic means for converting said sound received by said microphone into the electromagnetic signal, and an output transmitter for transmitting the electromagnetic signal and being adapted to be placed supercutaneously behind at least one ear of a hearing impaired person and having a first permanent magnet means therein, and vibration generating means adapted to be implanted subcutaneously and comprising a bone screw for being implanted in the mastoid area of the temporal bone behind the ear of the person and a second permanent magnet means connected to said bone screw (1) for cooperating with said first permanent magnet means to hold said transmitter in position supercutaneously behind the ear of the person, (2) for receiving the elecromagnetic signal from said transmitter of said sound processing means, and (3) for vibrating said bone screw and the temporal bone of the person in response to such electromagnetic signal, said bone screw including a cap on the end thereof opposite the end implanted in the temporal bone and said second permanent magnet being adhered to said cap; whereby vibrations are generated subcutaneously in response to an analog electromagnetic signal and conducted through the bone of the skull to stimulate the inner ear to create the perception of sound.

18. A hearing aid device, according to claim 17, wherein said second permanent magnet means and portion of said cap on said bone screw are encased in a silicone material.

19. A hearing aid device, according to claim 18, wherein said first and second magnet means are of the samarium-cobalt type.

20. A hearing aid device, according to claim 19, wherein said bone screw is formed of titanium.

* * * * *